US008356416B1

(12) United States Patent
Johnson

(10) Patent No.: US 8,356,416 B1
(45) Date of Patent: Jan. 22, 2013

(54) ARCHERY BOW SIGHT WITH A PIN ILLUMINATED BY A PROTECTED OPTICAL FIBER

(76) Inventor: Steven C. Johnson, Harrisburg, OR (US)

( * ) Notice: Subject to any disclaimer, the term of this patent is extended or adjusted under 35 U.S.C. 154(b) by 307 days.

(21) Appl. No.: 12/916,381

(22) Filed: Oct. 29, 2010

(51) Int. Cl.
*F41G 1/467* (2006.01)

(52) U.S. Cl. ..... 33/265; 124/87

(58) Field of Classification Search ..... 33/265; 124/87
See application file for complete search history.

(56) References Cited

U.S. PATENT DOCUMENTS 5,201,124 A 4/1993 Sherman
6,634,110 B2 10/2003 Johnson
7,100,291 B2 9/2006 Afshari
7,278,216 B2 10/2007 Grace
7,603,784 B2 10/2009 Erhard
7,921,570 B1 * 4/2011 Pulkrabek et al. ..... 33/265
8,151,473 B2 * 4/2012 Sims et al. ..... 33/265
8,171,648 B2 * 5/2012 Summers et al. ..... 33/265
2006/0156561 A1 * 7/2006 Afshari ..... 33/265
2012/0186089 A1 * 7/2012 Willis ..... 33/265

* cited by examiner

*Primary Examiner* — R. A. Smith
(74) *Attorney, Agent, or Firm* — David S. Alavi

(57) ABSTRACT

A sight pin for an archery sight comprises a sight pin member having an integrally formed fiber channel. The fiber channel is arranged to hold the optical fiber in a curvilinear arrangement so that light emergent from the fiber is directed in a rearward direction from a sight reference point on the sight pin member. At least a portion the fiber channel comprises rows of depressions formed on opposing transverse surfaces of the sight pin member that overlap to form transverse passages through the sight pin member. An optical fiber in the fiber channel is exposed by the depressions and passages from transverse directions but protected from a forward direction by a forward-facing surface of the sight pin member.

26 Claims, 5 Drawing Sheets

101
102
104
106
108
110a
110b
120/299
122a
122b
124

ARCHERY BOW SIGHT WITH A PIN ILLUMINATED BY A PROTECTED OPTICAL FIBER

BACKGROUND

The field of the present invention relates to archery sights. In particular, an archery bow sight is disclosed herein that includes one or more pins that are each illuminated by a corresponding protected optical fiber.

A wide variety of archery bow sights have been developed previously. Ideally, in a typical archery bow sight, a pin, reticle, cross-hair, or other reference marker is positioned relative to the bow so that when visually aligned on a target object at a given distance (i.e., when the archer holding the drawn bow looks through the sight with the reference marker on the target object), an arrow shot by the bow will hit the target object. One example of a suitable type of archery bow sight 300 is disclosed, e.g., in U.S. Pat. No. 6,634,110 issued to Johnson, and includes a sight ring 310 and multiple sight pins 350 mounted on the sight ring 310 and extending toward its center (as in the example illustrated in FIG. 1; only one sight pin 350 is shown). The sight ring 310 is attached to and held in position relative to an archery bow (not shown) by mounting hardware 320, which can typically include one or more adjustment mechanisms 330 or 340 for properly positioning the sight ring 310 and sight pins 350, respectively, relative to the bow. Any suitable or desirable combination of one or more degrees of translation or rotational freedom can be provided by the adjustment mechanism. Once the archery bow sight 300 is properly adjusted, to aim the bow, the archer aims the bow and sight 300 so that a sight reference point 399 near the tip of one of the pins 350 is visually aligned with a target object. In many cases, the archery sight 300 includes multiple sight pins 350 arranged to define multiple corresponding sight reference points 399 along a substantially vertical sight line 398 within the sight ring 310. In such an arrangement, each sight pin 350 corresponds to a different distance-to-target, and the archer visually aligns the appropriate sight reference point 350 on the target object according to the archer's knowledge or estimate of that distance. The sight line 398 can be an virtual line along which the multiple sight reference points are arranged, or can comprise an actual string, wire, or other structure spanning the sight ring 310.

Illumination of each pin 350 at its corresponding sight reference point 399 enhances its visibility to the archer and thereby facilitates the archer's use of the archery bow sight 300. In some examples, the sight reference point 399 is illuminated by the distal end of a corresponding optical fiber 360. A proximal portion (not shown) of each optical fiber 360 is arranged in any suitable way to receive light (ambient light or light from a light source), while a distal portion of each optical fiber 360 is arranged on the pin 350 to transmit at least a portion of the received light to emit the transmitted portion from its distal end at the sight reference point 399.

To direct the light emitted from the distal end of the optical fiber 360 in a rearward direction 2 (relative to the forward, shooting direction 1 of the bow), toward the archer, the most distal segment of the optical fiber 360 is arranged substantially parallel to a forward-rearward axis (hereinafter referred to as the sighting axis). The pin 350, however, extends across a portion of the sight ring 310 in a substantially transverse direction, so that a more proximal segment of the optical fiber 360 typically is bent so that a still more proximal segment lies along or across a forward edge or surface of a sight pin member 301 of the pin 350, as in the example of FIGS. 1 and 2A-2C.

The optical fiber 360 typically is somewhat fragile, and segments of the optical fiber 360 are relatively exposed at the front edge or surface of the pin member 301. That combination of fragility and exposure can lead to damage or breakage of the optical fiber 360 during handling or use of the bow. For example, accidental bumping or other impact on the optical fiber can damage it or break it, e.g., during mounting or installing the archery bow sight 300 on the bow or during adjustment of the position or alignment of the archery bow sight 300 relative to the bow. Bow hunters sometimes use their bows to push through brush or foliage while hunting, also potentially leading to damage or breakage of the optical fiber 360.

Enclosing the exposed portions of the optical fiber 360 within a metal tube (e.g., such as tubing suitable for making hypodermic needles) has been employed to protect the optical fiber, but such tubing often proves to be nearly as fragile as the optical fiber.

SUMMARY

A sight pin for an archery sight comprises a sight pin member having an integrally formed fiber channel. The fiber channel is arranged to hold the optical fiber in a curvilinear arrangement so that light emergent from the fiber is directed in a rearward direction from a sight reference point on the sight pin member. At least a portion the fiber channel comprises rows of depressions formed on opposing transverse surfaces of the sight pin member that overlap to form transverse passages through the sight pin member. An optical fiber in the fiber channel is exposed by the depressions and passages from transverse directions but protected from a forward direction by a forward-facing surface of the sight pin member.

A method comprises integrally forming the fiber channel in the sight pin member. An archery bow sight comprises one or more of the archery pins attached to a sight support member. Another method comprises attaching one or more sight pins to a sight support member.

Objects and advantages pertaining to sight pins for archery sights may become apparent upon referring to the exemplary embodiments illustrated in the drawings and disclosed in the following written description or appended claims.

Figure 1:
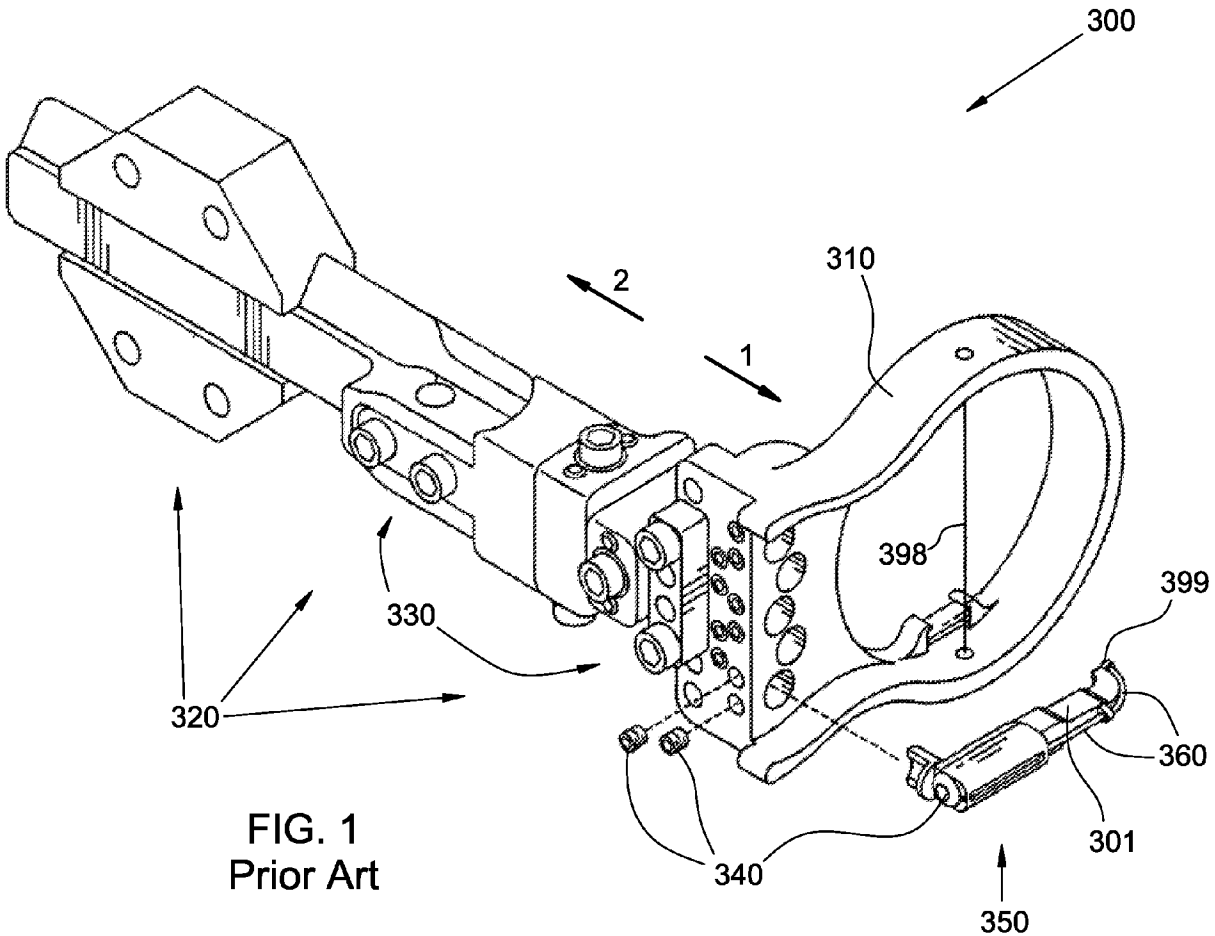
FIG. 1 Prior Art
FIG. 1 is a perspective view of a conventional archery sight assembly.
Figure 2C:
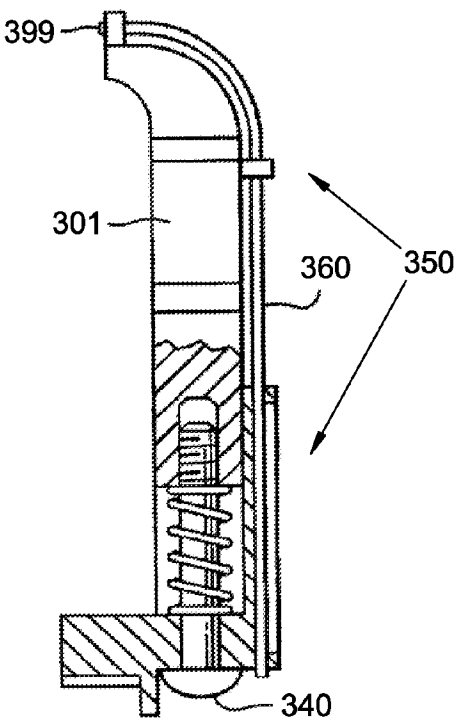
FIG. 2C Prior Art
FIGS. 2A, 2B, and 2C are front, transverse, and transverse cross-sectional views, respectively, of a conventional fiber-illuminated archery sight pin.
Figure 2B:
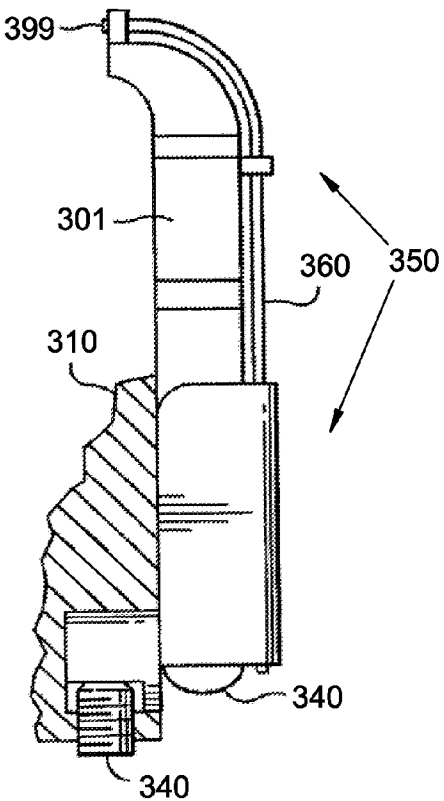
FIG. 2B Prior Art
Figure 2A:
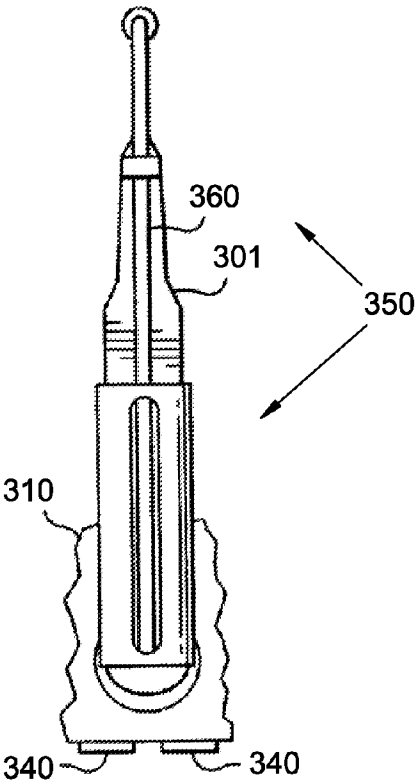
FIG. 2A Prior Art

The embodiments shown in the drawings are exemplary only, and should not be construed as limiting the scope of the present disclosure or appended claims.

DETAILED DESCRIPTION OF EMBODIMENTS

Figure 3:
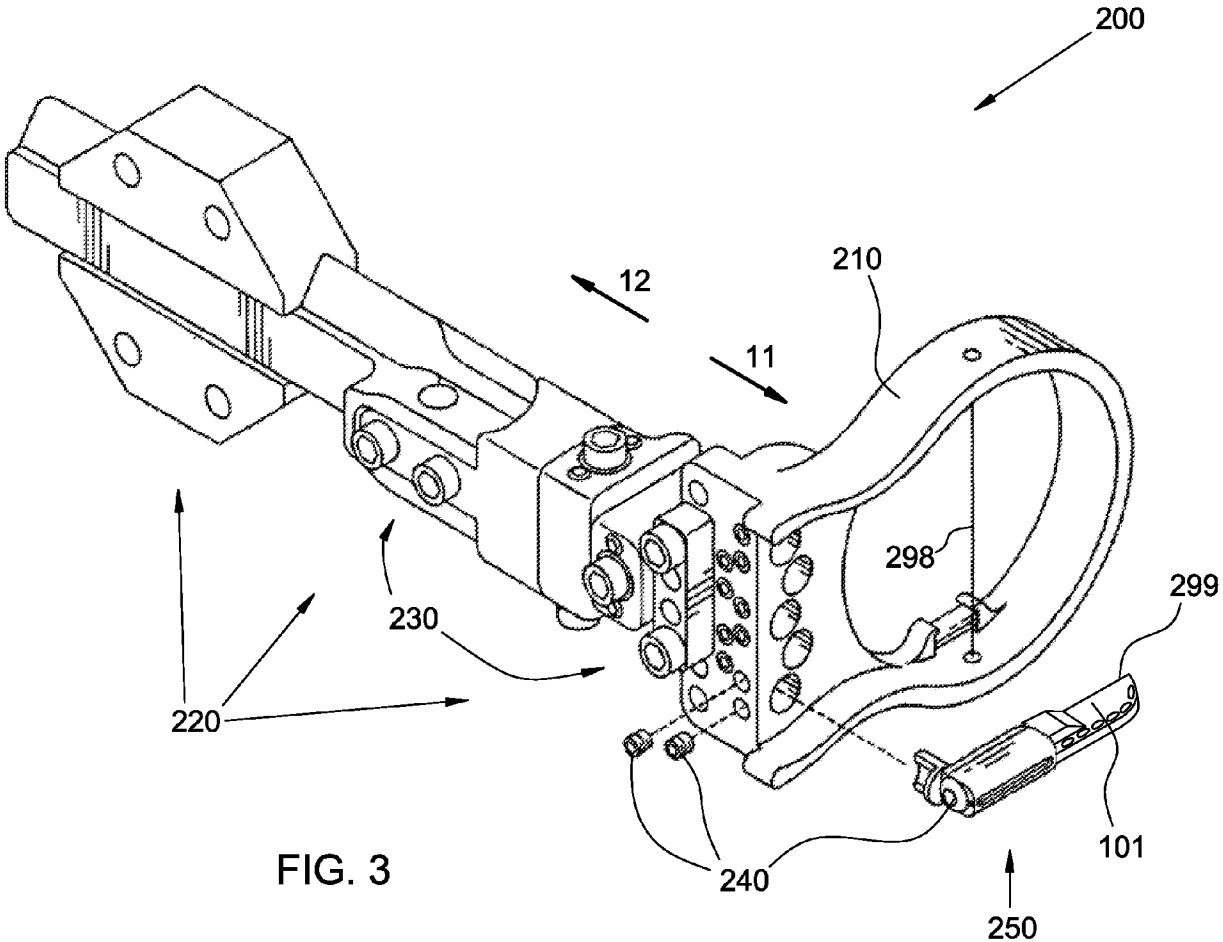
FIG. 3 is a perspective view of an exemplary archery sight assembly according to the present disclosure or appended claims.
Figure 4C:
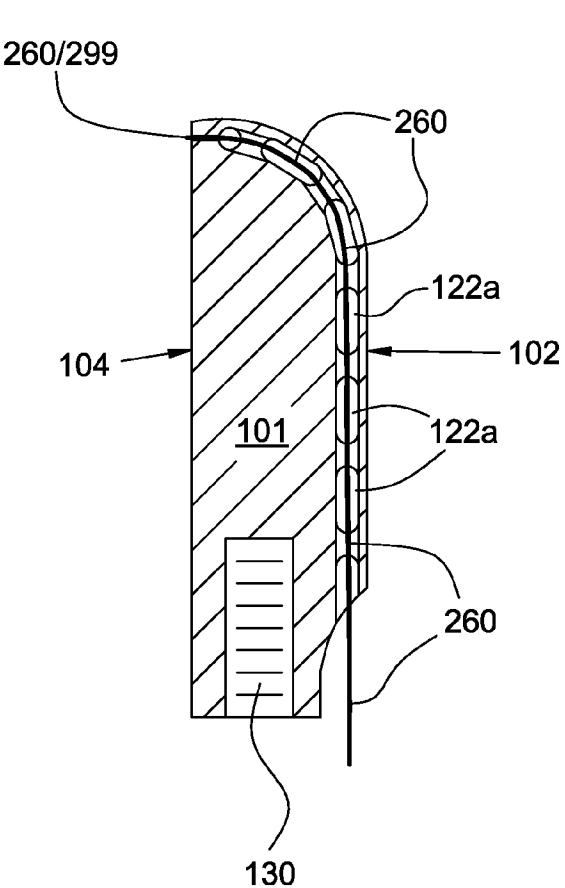
FIGS. 4A, 4B, and 4C are front, transverse, and transverse cross-sectional views, respectively, of an exemplary fiber-illuminated archery sight pin member and optical fiber arranged according to the present disclosure or appended claims.
Figure 4B:
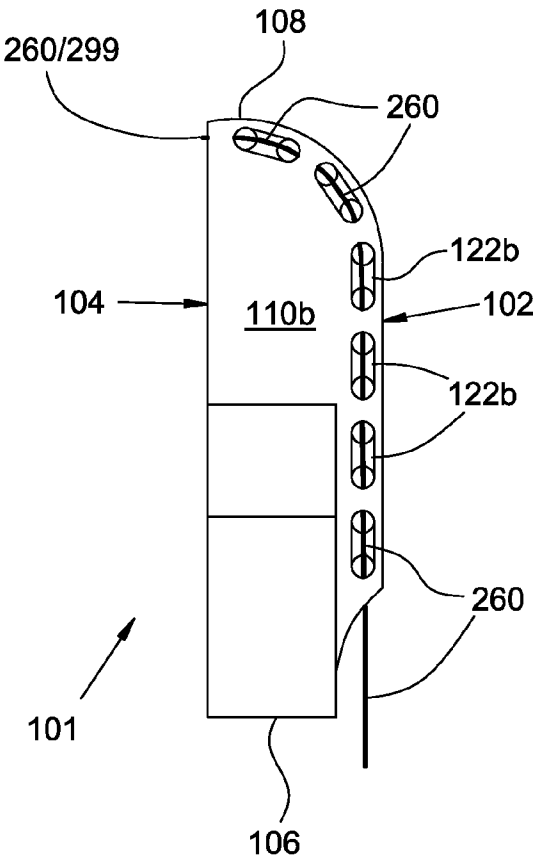
Figure 4A:
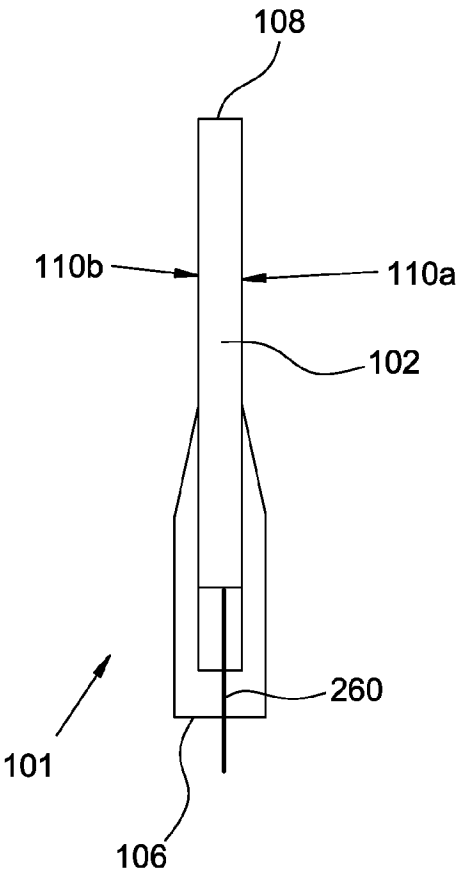
Figures 5A, 5B, 5C:
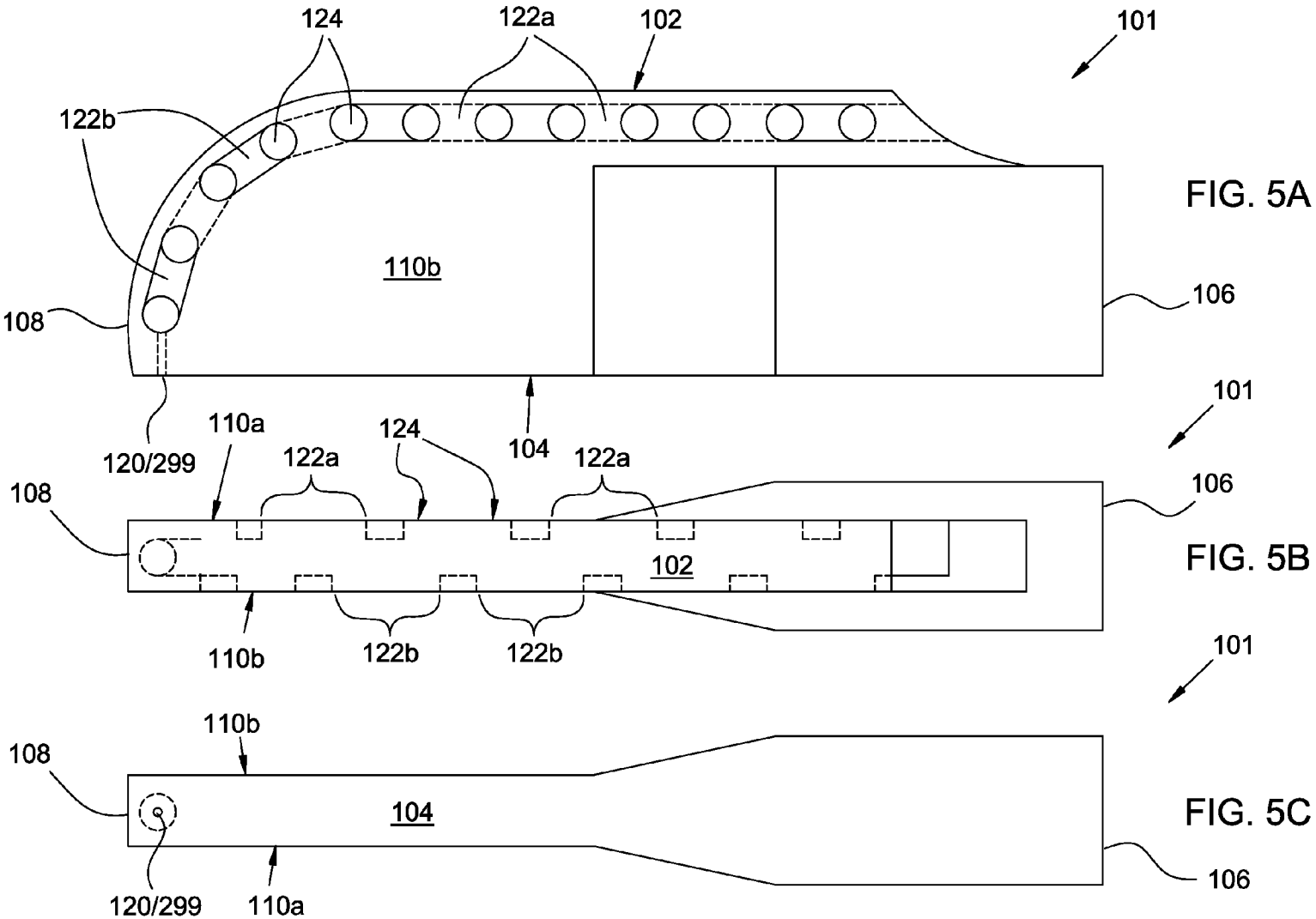
FIGS. 5A, 5B, and 5C are transverse, front, and rear views of an exemplary sight pin member arranged according to the present disclosure or appended claims.

An exemplary archery sight assembly 200 is illustrated in FIG. 3 and comprises a sight ring 210 and multiple sight pins 250 mounted on the sight ring 210 and extending toward its center (only one sight pin 250 is shown). The sight ring 210 is attached to and held in position relative to an archery bow (not shown) by mounting hardware 220, which can typically include one or more adjustment mechanisms 230 or 240 for properly positioning the sight ring 210 and sight pins 250, respectively, relative to the bow. Any suitable adjustment mechanisms or combinations thereof can be employed, e.g., screws, slides, bearings, knobs, gears, dials, pointers, clamps, and so forth. Any suitable or desirable combination of one or more degrees of translation or rotational freedom can be provided by the adjustment mechanisms. Once the archery bow sight 200 is properly adjusted, to aim the bow, the archer aims the bow and sight 200 so that a sight reference point 299 near the tip of one of the pins 250 is visually aligned with a target object, as with the conventional archery sight 300. As is also the case with the conventional archery sight 300, the archery sight 200 can include multiple sight pins 250 arranged to define multiple corresponding sight reference points 299 along a substantially vertical sight line 298 within the sight ring 210 (only one sight pin is shown in the drawings). In such an arrangement, each sight pin 250 corresponds to a different distance-to-target, and the archer visually aligns the appropriate sight reference point 250 on the target object according to the archer's knowledge or estimate of that distance. The sight line 298 can be an virtual line along which the multiple sight reference points are arranged, or can comprise an actual string, wire, or other structure spanning the sight ring 210.

As with the conventional archery sight 300, illumination of each pin 250 at its corresponding sight reference point 299 enhances its visibility to the archer and thereby facilitates the archer's use of the archery bow sight 200. In the exemplary archery sight 200, the sight reference point 299 is illuminated by the distal end of a corresponding optical fiber 260. A proximal portion (not shown) of each optical fiber 260 is arranged in any suitable way to receive light (ambient light or light from a light source), while a distal portion of each optical fiber 260 is arranged on the pin 250 to transmit at least a portion of the received light to emit the transmitted portion from its distal end at the sight reference point 299.

To direct the light emitted from the distal end of the optical fiber 260 in a rearward direction 12 (relative to the forward, shooting direction 11 of the bow), toward the archer, the most distal segment of the optical fiber 260 is arranged substantially parallel to a forward-rearward axis (hereinafter referred to as the sighting axis 11/12). The pin 250, however, typically extends across a portion of the sight ring 210 generally transverse to the sighting axis 11/12, so that a more proximal segment of the optical fiber 260 typically is bent so that a still more proximal segment is directed generally transverse to the sighting direction 11/12. In the exemplary archery sight 200, each sight pin 250 includes a corresponding sight pin member 101 that has in integrally formed fiber channel 120.

An exemplary sight pin member 101 is shown in FIGS. 4A-4C and 5A-5C, and has a proximal end 106, a distal end 108, a forward-facing surface 102, a rearward-facing surface 104, a pair of opposed transverse-facing surfaces 110*a*/110*b* joining the forward- and rearward-facing surfaces 102/104, and the integrally formed fiber channel 120. The fiber channel is arranged to hold the optical fiber 260 in a curvilinear arrangement (i.e., an arrangement that includes one or more linear segments, one or more curved segments, or both linear and curved segments) routed through the sight pin member 101. That curvilinear arrangement includes a distal segment, a proximal segment, and typically also includes a curved segment between the distal and proximal segments. The fiber channel 120 is arranged to receive the optical fiber 260 and to position a distal segment of the optical fiber so that a substantial portion of light emergent from a distal end of the optical fiber is directed in a rearward direction from a sight reference point 299 on the rearward-facing surface 104 near the distal end 108 of the sight pin member 101. The proximal portion of the fiber channel 120 can be adapted or arranged in any suitable way to receive and secure the optical fiber 260 in the fiber channel 120. For example, the proximal end of the fiber channel 120 can comprise an opening through a proximal surface of the pin member 101, a mounting bracket or member formed on the sight pin 250 or sight pin member 101, a tube or receptacle (not shown) for guiding the fiber 260 into the fiber channel 120, or any other suitable structure, adaptation, or arrangement.

At least a portion of the fiber channel 120, including any curved segment thereof, comprises (i) a row of discrete passages 124 through the sight pin member that connect the opposed transverse-facing surfaces 110*a*/110*b*, (ii) a first row of discrete depressions 122*a* formed on the transverse-facing surface 110*a*, and (iii) a second row of discrete depressions formed on the transverse-facing surface 110*b*. Each depression 122*a* or 122*b* joins a pair of adjacent passages 124 and has a depth that is (i) less than a length of each of the joined passages 124 (i.e., the depressions do not extend all the way through the sight pin member 101) and (ii) greater than half that length.

An exemplary method for forming the sight pin member 101 comprises forming the first row of depressions 122*a* on the transverse-facing surface 110*a*, forming the second row of depressions 122*b* on the opposite transverse-facing surface 110*b*, and forming proximal and distal segments of the fiber channel 120. Each row of depressions 122*a*/122*b* is formed on the respective surface 110*a*/110*b* along a path that corresponds to at least a portion of the fiber channel 120 (including a curved segment, if any). Overlapping portions of depressions 122*a*/122*b* can form the passages 124 that connect the transverse-facing surfaces 110*a*/110*b*, or those passages 124 can be formed in a separate step before forming the depressions 122*a*/122*b*.

Typically, but not necessarily, each passage 124 is joined to at most one other passage 124 on surface 110*a*, and is joined to at most one other passage 124 on surface 110*b* (typically not the same passage to which it is joined on surface 110*a*). The depressions 122*a*/122*b* and passages 124 can form only a portion of the fiber channel (e.g., including any curved segment thereof), or can also form at least portions of the proximal and distal segments of the fiber channel 120. At least a portion of the distal segment of the fiber channel 120 can be arranged to enclose the optical fiber 260, e.g., to hold it in place to define the sight reference point 299 and to direct light emergent from the fiber in the rearward direction.

The optical fiber 260 is positioned in the fiber channel 120 with a distal end of the optical fiber 260 arranged to that light emergent therefrom is directed in the rearward direction 12 from the sight reference point 299 on the rearward-facing surface 104 near the distal end 108 of the sight pin member 101. The optical fiber thus positioned is exposed from a transverse direction at each of the depressions 122*a*/122*b* and passages 124. The passages 124 and depressions 122*a*/122*b* are arranged, however, so that portions of the optical fiber 260 are obstructed, by portions of the forward-facing surface 102 of the sight pin member 101, from an impact from a forward direction.

The exemplary sight pin member 101 can be incorporated in any suitable way into a sight pin 250 that can in turn be substantially rigidly attached to the archery sight 200 in any suitable way. For example, a threaded hole 130 can enable the sight pin member 101 to be attached to the sight pin 250. Alternatively, the sight pin member 101 can be integrally formed as part of the sight pin 250, which is in turn arranged to be attached to the archery sight 250. In any case, one or more sight pins 250 are attached to the sight ring 210 or other suitable sight support member. A sight ring 210 (with the sight pins 250 extending radially inward at least partly across the ring) is a convenient arrangement for such a sight support member, but other shapes or arrangements can be employed as suitable, needed, or desired. Each sight pin typically is adjustably attached to the sight ring 210, and can be adjusted by any suitable adjustment hardware 240 along any suitable degrees of freedom. The position and alignment of sight ring 210 typically can be accomplished by any suitable adjustment hardware 230 along any suitable degrees of freedom.

The archery sight 200 is arranged so that, when mounted on an archery bow, the sighting direction is substantially parallel to the arrow flight direction defined by the bow. Consequently, light emergent from the end of the corresponding optical fiber 260 from the corresponding sight reference point 299 on each sight pin 250 is directed in the rearward direction relative to the archery sight 200 and the bow.

The arrangement of passages 124 and depressions 122*a*/122*b* protects the optical fiber 260 from impacts from a forward direction. The forward-facing surface 102 can remain substantially continuous and can therefore protect the optical fiber 260 from forward impacts. Although the fiber 260 is exposed in transverse directions by depressions 122*a*/122*b* and passages 124, that exposure is limited by the small size of the depressions 122*a*/122*b* and passages 124. In addition, the sight ring 210 or other sight support member typically obstructs impacts from transverse directions. Impacts from the rearward direction are less likely to occur, because the archer usual moves forward, and would himself somewhat obstruct the entire archery sight 200 from most rearward impacts.

The arrangement of depressions 122*a*/122*b* and passage 124 facilitates fabrication of the sight pin member 101 with an integrally-formed fiber channel 120 that is curved. Drilling such an enclosed, curved channel through a monolithic sight pin member 101 would be problematic or perhaps impossible, as would molding a monolithic sight pin member with an enclosed, curved channel. Assembling the sight pin member 101 from discrete halves, with one or both having a groove that becomes enclosed upon assembly of the halves, could be employed but would require more complex fabrication and assembly processes. The depression/passage arrangement of the exemplary sight pin member 101 disclosed or claimed herein can be formed by simple milling, molding, or other suitable fabrication technique applied to the surfaces of a monolithic sight pin member, enabling a fiber channel 120 having an arbitrarily curved path to be formed without introducing complex machining, molding, or other techniques or additional assembly steps. The sight pin member 101 can comprise any suitable material that is sufficiently rigid to retain the optical fiber 260 and hold it in position sufficiently accurately for use in an archery sight. Examples of suitable materials can include metal (e.g., aluminum) or plastic.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

In the foregoing Detailed Description, various features may be grouped together in several exemplary embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed exemplary embodiment. Thus, the appended claims are hereby incorporated into the Detailed Description, with each claim standing on its own as a separate disclosed embodiment. However, the present disclosure shall also be construed as implicitly disclosing any embodiment having any suitable combination of disclosed or claimed features (i.e., combinations of features that are not incompatible or mutually exclusive) that appear in the present disclosure or the appended claims, including those combinations of features that may not be explicitly disclosed herein. It should be further noted that the scope of the appended claims do not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or", "only one of . . . ", or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof, wherever they appear, shall be construed as open ended terminology, with the same meaning as if the phrase "at least" were appended after each instance thereof.

In the appended claims, if the provisions of 35 USC §112 ¶ 6 are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112 ¶ 6 are not intended to be invoked for that claim.

What is claimed is:

1. A sight pin for an archery bow sight, the sight pin comprising a sight pin member having a proximal end, a distal end, a forward-facing surface, a rearward-facing surface, a pair of opposed transverse-facing surfaces joining the forward- and rearward-facing surfaces, and an integrally formed fiber channel, wherein:

(a) the fiber channel is arranged to receive an optical fiber and to position a distal segment of the optical fiber so that a substantial portion of light emergent from a distal end of the optical fiber is directed in a rearward direction from a sight reference point on the rearward-facing surface near the distal end of the sight pin member;

(b) the fiber channel is further arranged to hold the optical fiber in a curvilinear arrangement routed through the sight pin member;

(c) at least a portion of the fiber channel comprises (i) a row of discrete passages through the sight pin member that connect the opposed transverse-facing surfaces, (ii) a first row of discrete depressions formed on a first one of the opposed transverse-facing surfaces, and (iii) a second row of discrete depressions formed on a second one of the opposed transverse-facing surfaces; and (d) each depression joins an adjacent pair of the passages and has a depth that is (i) less than a length of each of the joined passages and (ii) greater than half that length.

2. The sight pin of claim 1 wherein the curvilinear arrangement includes distal, proximal, and curved segments of the fiber channel, with the curved segment between the distal and proximal segments, and at least the curved segment comprises corresponding portions of the rows of passages and depressions.

3. The sight pin of claim 1 wherein each of the passages is joined to at most one other of the passages on each transverse-facing surface of the sight pin member.

4. The sight pin of claim 2 wherein a portion of the proximal segment of the fiber channel comprises corresponding portions of the rows of passages and depressions.

5. The sight pin of claim 1 wherein the fiber channel includes a portion that encloses at least a portion of the distal segment of the optical fiber.

6. The sight pin of claim 1 wherein the proximal end of the sight pin member is arranged to attach the sight pin substantially rigidly to a sight support member.

7. The sight pin of claim 1 further comprising an optical fiber received within the fiber channel with a distal segment thereof positioned so that a substantial portion of light emergent from a distal end of the optical fiber is directed in the rearward direction from the sight reference point on the rearward-facing surface near the distal end of the sight pin member, wherein:

the optical fiber in the fiber channel is exposed from a transverse direction at each of the depressions and passages; and the passages and depressions are arranged so that portions of the optical fiber are obstructed, by portions of the forward-facing surface of the sight pin member, from an impact from a forward direction.

8. An archery bow sight incorporating one or more sight pins of claim 1, further comprising a sight support member arranged to define a sighting axis and forward and rearward directions along the sighting axis, wherein:

(a) each of the one or more sight pins is substantially rigidly attached at its proximal end to the sight support member with its distal end extending in a direction transverse to the sighting direction; and (b) each of the one or more sight pins is positioned so that a substantial portion of light emergent from the distal end of a corresponding optical fiber is directed in the rearward direction along the sighting axis.

9. The archery sight of claim 8 further comprising a corresponding optical fiber received within each of the one or more fiber channels with a distal segment of the optical fiber positioned so that a substantial portion of light emergent from a distal end of the optical fiber is directed in the rearward direction from the sight reference point on the rearward-facing surface near the distal end of the corresponding sight pin member, wherein:

each optical fiber in the corresponding fiber channel is exposed from a transverse direction at each of the depressions and passages; and the passages and depressions are arranged so that portions of the corresponding optical fiber are obstructed, by portions of the forward-facing surface of the corresponding sight pin member, from an impact from a forward direction.

10. The archery sight of claim 8 wherein each of the one or more sight pins is adjustably attached to the sight support member.

11. The archery sight of claim 8 wherein the sight support member comprises a sight ring and each of the one or more sight pins extends radially inwardly at least partly across the sight ring.

12. The archery sight of claim 8 further comprising a mounting bracket substantially rigidly connected to the sight support member and arranged to be substantially rigidly connected to an archery bow with the sighting axis substantially parallel to an arrow flight direction defined by the bow.

13. The archery sight of claim 12 wherein the mounting bracket is arranged to enable adjustment of position and orientation of the sight support member relative to the archery bow.

14. A method for making an archery bow sight incorporating one or more sight pins of claim 1, the method comprising substantially rigidly attaching each of the one or more sight pins at its proximal end to a sight support member arranged to define a sighting axis and forward and rearward directions along the sighting axis, wherein:

(a) each of the one or more sight pins thus attached is positioned so that its distal end extends in a direction transverse to the sighting direction; and (b) each of the one or more sight pins thus attached is positioned so that a substantial portion of light emergent from the distal end of a corresponding optical fiber is directed in the rearward direction along the sighting axis.

15. The method of claim 14 further comprising positioning a corresponding optical fiber within the corresponding fiber channel of each of the one or more sight pins with a distal segment of the optical fiber positioned so that a substantial portion of light emergent from a distal end of the optical fiber is directed in the rearward direction from the sight reference point on the rearward-facing surface near the distal end of the corresponding sight pin member, wherein:

the corresponding optical fiber in the corresponding fiber channel is exposed from a transverse direction at each of the corresponding depressions and passages; and the passages and depressions are arranged so that portions of the corresponding optical fiber are obstructed, by portions of a forward-facing surface of the corresponding sight pin member that joins its first and second transverse-facing surfaces, from an impact from a forward direction.

16. The method of claim 14 wherein each of the one or more sight pins is adjustably attached to the sight support member.

17. The method of claim 14 wherein the sight support member comprises a sight ring and each of the one or more sight pins extends radially inwardly at least partly across the sight ring.

18. The method of claim 14 further comprising substantially rigidly connecting a mounting bracket to the sight support member, wherein said mounting bracket is arranged to be substantially rigidly connected to an archery bow with the sighting axis substantially parallel to an arrow flight direction defined by the bow.

19. The method of claim 18 wherein the mounting bracket is arranged to enable adjustment of position and orientation of the sight support member relative to the archery bow.

20. A method comprising:

(a) forming a first row of discrete depressions on a first transverse-facing surface of a sight pin member along a path that corresponds to at least an intermediate segment of a fiber channel within the sight pin member; and (b) forming a second row of discrete depressions on a second transverse-facing surface of the sight pin member, opposite the first transverse-facing surface, along a path that corresponds to at least the intermediate segment of the fiber channel, so that overlapping portions of depressions of the first and second rows form one or more passages connecting the first and second transverse-facing surfaces; and (c) forming proximal and distal segments of the fiber channel within the sight pin member, with the intermediate segment between the proximal and distal segments, wherein:

(d) the first and second rows of depressions are arranged so that each depression joins an adjacent pair of the passages, and each depression has a depth that is (i) less than a length of each of the joined passages and (ii) greater than half that length;

(e) the depressions and passages form at least a portion of the fiber channel;

(f) the fiber channel is arranged to receive an optical fiber and to position a distal segment of the optical fiber so that a substantial portion of light emergent from a distal end of the optical fiber is directed in a rearward direction from a sight reference point on the rearward-facing surface near the distal end of the sight pin member; and (g) the proximal, distal, and intermediate segments are arranged to hold the optical fiber in a curvilinear arrangement routed through the sight pin member.

21. The method of claim 20 wherein the curvilinear arrangement includes the distal, proximal, and intermediate segments of the fiber channel, and the intermediate segment is curved and comprises corresponding portions of the rows of passages and depressions.

22. The method of claim 20 wherein each of the passages is joined to at most one other of the passages on each transverse-facing surface of the sight pin member.

23. The method of claim 21 wherein a portion of the proximal segment of the fiber channel comprises corresponding portions of the rows of passages and depressions.

24. The method of claim 20 wherein the fiber channel includes a portion that encloses at least a portion of the distal segment of the optical fiber.

25. The method of claim 20 further comprising arranging the proximal end of the sight pin member to attach the sight pin substantially rigidly to a sight support member.

26. The method of claim 20 further comprising positioning an optical fiber within the fiber channel with a distal segment thereof positioned so that a substantial portion of light emergent from a distal end of the optical fiber is directed in the rearward direction from the sight reference point on the rearward-facing surface near the distal end of the sight pin member, wherein:

the optical fiber in the fiber channel is exposed from a transverse direction at each of the depressions and passages; and the passages and depressions are arranged so that portions of the optical fiber are obstructed, by portions of a forward-facing surface of the sight pin member that joins the first and second transverse-facing surfaces, from an impact from a forward direction.

* * * * *